United States Patent [19]

Hatcher et al.

[11] 4,078,371

[45] Mar. 14, 1978

[54] APPARATUS AND PROCESS SUITABLE FOR TWISTING A YARN

[75] Inventors: Charles S. Hatcher, Greenville, S.C.; Kenneth E. Smith, Bartlesville, Okla.

[73] Assignee: Phillips Petroleum Company, Bartlesville, Okla.

[21] Appl. No.: 772,180

[22] Filed: Feb. 25, 1977

[51] Int. Cl.[2] ..... D01H 7/86; D01H 13/10; B65H 59/32

[52] U.S. Cl. ..... 57/58.86; 57/156; 242/154

[58] Field of Search ..... 57/58.49, 58.83, 58.86, 57/106; 242/153, 154

[56] References Cited

U.S. PATENT DOCUMENTS

| | | | |
|---|---|---|---|
| 2,552,150 | 5/1951 | Cochran | 57/58.86 |
| 2,556,290 | 6/1951 | Nelson | 242/154 |
| 2,571,678 | 10/1951 | Burns | 242/154 |
| 2,776,805 | 1/1957 | Klein | 57/58.86 X |
| 2,795,924 | 6/1957 | Borges, Jr. | 57/58.86 |
| 2,811,013 | 10/1957 | Klein | 57/58.86 |
| 2,921,755 | 1/1960 | Borges, Jr. | 242/154 |
| 2,932,151 | 4/1960 | Heffelfinger et al. | 57/58.86 |
| 3,087,689 | 4/1963 | Heim | 242/154 |
| 3,199,808 | 8/1965 | Tata | 242/154 |

*Primary Examiner*—John Petrakes

[57] ABSTRACT

A yarn is twisted by passing the yarn wound on a package to a tensioning zone and then passing the yarn to a 2-for-1 twist spindle and twisting the yarn. The tension applied to the yarn in the tensioning zone is the result of the sinusoidal path of the yarn through the tension zone and is a function of the amplitude of the yarn passing through the sinusoidal path.

8 Claims, 3 Drawing Figures

APPARATUS AND PROCESS SUITABLE FOR TWISTING A YARN

BACKGROUND OF THE INVENTION

The invention relates to an apparatus suitable for twisting a yarn. In another aspect, the invention relates to a method suitable for twisting a yarn. In still another aspect the invention relates to an apparatus and method suitable for twisting an as spun yarn.

The use of synthetic yarns presently dominates the textile industry. Although some natural fibers such as cotton and wool are still used today, the majority of yarns used to produce clothing, carpeting, upholstery material and other textile goods are primarily synthetic yarns. In order for synthetic yarns to resemble yarns made from natural fibers, it is necessary to texture or bulk the synthetic yarns. Texturing synthetic yarns in order that such yarns when made into fabrics will have the hand and feel of fabrics made from natural staple yarns is well known in the art. The various texturing processes used to texture synthetic yarns also employ a variety of feed yarns. For example, a feed yarn can be drawn, partially drawn or undrawn and a feed yarn can be twisted or entangled to bind the filaments in the yarn closer together because a yarn that is not twisted or entangled often has filaments that become separated from the yarn that can snag and break during the various processing steps. Also packages of feed yarn should be used in a size or weight best suited for the particular process used. Some of the more commonly employed texturing processes use a feed yarn that has been twisted and drawn. To produce such a feed yarn, a draw-twist machine is frequently used. Such a machine, which is well known in the art, draws an as spun yarn and then twists the drawn yarn during windup by feeding the yarn to a rotating vertically mounted takeup bobbin through a rotatable "flyer" driven only by the angular momentum of the yarn. Although this type of machine works very well and is widely used, the packages of draw-twisted yarn that can be produced on such machines are relatively small because the windup bobbin itself must be rotated. In some texturing processes where large packages of feed yarn are desirable it is necessary to splice and recone the draw-twisted yarn to make larger feed yarn packages.

The problem of package size along with other disadvantages of the draw-twist process are overcome by use of the twist-draw process, that is, where the as spun yarn is twisted by a 2-for-1 twister and then drawn. In such a process the yarn is twisted prior to winding so that the types of winders employed are capable of winding much larger packages of yarn as compared to the takeup bobbin used on draw-twist machines. Although the twist-draw process solves problems that are encountered with draw-twist processes, the twist-draw process itself has some problems and one of the more difficult problems with the twist-draw process has been in the control of the tension of the yarn passed to the twisting spindle on the 2-for-1 twister. Prior to the present invention the tension devices used on 2-for-1 twisters employed pinch points that trapped the yarn between two surfaces. However, the use of 2-for-1 twisters having tension devices employing pinch points to regulate the tension in the yarn generally has been unsatisfactory because of filament breakage; thus there is a need for a 2-for-1 twister that can twist an as spun yarn with the elimination of or at least only a minimum number of broken filaments.

An object of the invention is a 2-for-1 twister.

Another object of the invention is an apparatus suitable for twisting an as spun yarn with a minimum of filament breakage.

Another object of the invention is twisting yarn.

Still another object of the invention is twisting an as spun yarn with minimum filament breakage.

SUMMARY OF THE INVENTION

According to the invention a 2-for-1 twister comprises a spindle support means, spindle, disc, tension device and package support means wherein the spindle is rotatably connected to the spindle support means, the disc is attached to the spindle above the spindle support means, the spindle is rotatably connected to the package support means which is positioned above the disc, and the tension device is attached to the package support means wherein the tension device comprises a fixed member and a movable member, said movable member having a first end and a second end, said first end being hinged to said fixed member in a manner to force the second end of said movable member away from said fixed member and said fixed member and said movable member having a plurality of yarn guides positioned thereon suitable for producing substantially a sinusoidal yarn path when a yarn is passed from said package to said yarn guides alternating between the guides on the fixed member and the guides on the movable member.

Further according to the invention, a yarn is twisted by passing the yarn from a package of yarn positioned on a 2-for-1 twister to a tensioning zone, then passing the yarn to a 2-for-1 twist spindle from said tensioning zone and twisting the yarn, wherein the yarn passed to the 2-for-1 twist spindle is tensioned by said tensioning zone and the yarn in said tensioning zone is substantially positioned in a sinusoidal path wherein the tension on the yarn is decreased as the amplitude of the sinusoidal path of the yarn is decreased and the tension in the yarn is increased as the amplitude of the sinusoidal path of the yarn is increased. The method and apparatus of the present invention are suitable for processing a yarn with a minimum number of filament breaks and are particularly well suited for twisting an as spun yarn.

DETAILED DESCRIPTION OF THE INVENTION

Figures 1, 2, 3:
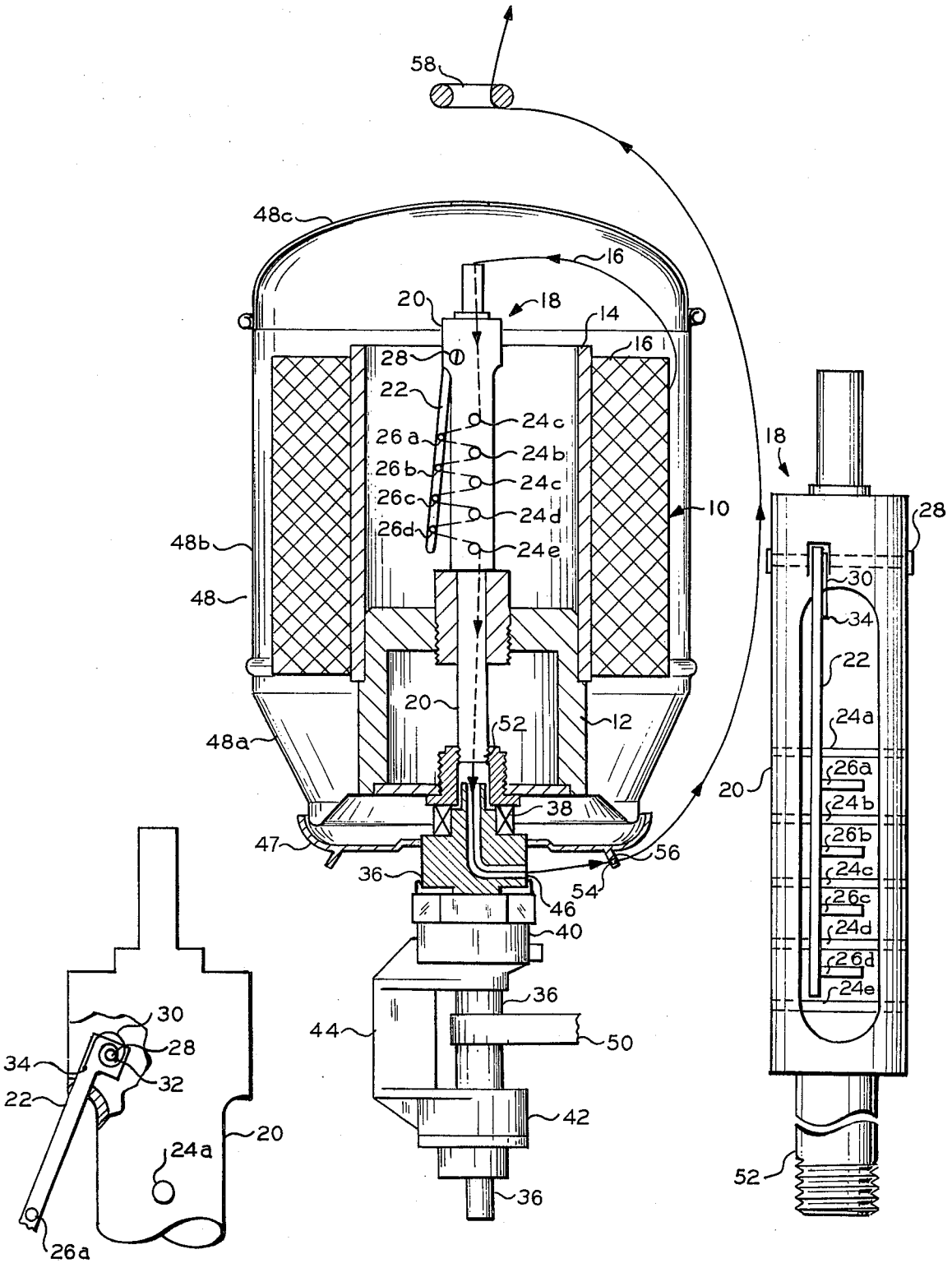
FIG. 1 is an illustration of one embodiment of a 2-for-1 twister in accordance with the invention.
FIG. 2 shows the top portion partially cut away of the tension device shown in FIG. 1.
FIG. 3 shows the tension device illustrated in FIG. 1 rotated 90° from that illustrated in FIG. 1.

In FIG. 1 of the drawing a package of yarn represented generally by reference numeral 10 is supported on package support means 12. The package of yarn comprises a package support member 14 and the yarn 16. Tension device represented generally by reference numeral 18 is positioned inside the package support and comprises a fixed member 20 and a movable member 22. Fixed member 20 is shown in this embodiment as a tube and has yarn guides 24*a, b, c, d* and *e* positioned inside the tube. Movable member 22 has yarn guides 26*a, b, c* and *d* and movable member 22 is hinged to fixed member 20 by pin 28, shown better in the cutaway section of FIG. 2 and in FIG. 3. As shown in FIG. 2 a spring 30 is coiled around pin 28 in a counterclockwise direction. One end of the spring is attached to pin 28 at point 32 by a suitable means and the other end of spring 30 is attached to movable member 22 at point 34 by a suitable means. As pin 28 is rotated in a clockwise direction the tension in spring 30 is increased which in turn forces the end of movable member 22 not attached to fixed member 20 away from fixed member 20. As shown in FIG. 3 yarn guides 26*a*, 26*b*, 26*c* and 26*d* are staggered between yarn guides 24*a*, 24*b*, 24*c*, 24*d* and 24*e* so as to provide substantially a sinusoidal yarn path as clearly shown in FIG. 1.

Spindle 36 extends to approximately the top of bearing 38 and through bearings 40 and 42 of spindle support means 44 which does not rotate. Spindle 36 has a yarn outlet orifice 46 and disc 47 is connected to spindle 36 just above yarn outlet orifice 46. A container 48 surrounds yarn package 10 and comprises a bottom portion 48*a*, a middle portion 48*b* and a top portion 48*c*. A suitable power means (not shown) is used to turn spindle 36 via belt 50.

In the operation of the apparatus yarn 16 is passed to the top of fixed member 20 of tension device 18 as a tensioning zone. Yarn 16 is passed through fixed member 20 to the first yarn guide 24*a*. Yarn 16 is wrapped approximately 90° around yarn guide 24*a* and then is wrapped approximately 180° around yarn guide 26*a* and so forth all the way along the yarn guides of tension device 18, thus forming substantially a sinusoidal yarn path. Since the package of yarn 10, package support means 12, container 48, tension device 18, and all other components above bearing 38 do not rotate during the operation of the 2-for-1 twister no centrifugal forces are involved and only the tension in spring 30 forces movable member 22 out and away from fixed member 20. As movable member 22 moves toward fixed member 20 the angle that the yarn is wrapped around the yarn guides 24*a* to *e* and 26*a* to *d* decreases which in turn decreases the tension in the yarn downstream of tension device 18. When the tension in the yarn downstream of tension device 18 is decreased spring 30 forces movable member 22 outward and away from fixed member 20, increasing the wrapping angle of the yarn around the yarn guides 24*a* to *e* and 26*a* to *d* and thus increasing the tension in the yarn downstream of tension device 18.

Yarn 16 is passed through the threaded end 52 of fixed member 20 of tension device 18 and into spindle 36 as shown by the dashed line and out of spindle 36 through orifice 6. Yarn 6 passes through ceramic eyelet 54 in skirt 56 of disc 48. Yarn 16 forms a "balloon" around container 48 and the yarn 16 is then passed through a guide 58 positioned above the top portion 48*c* of container 48.

It is pointed out that the particular tension device 18 shown in the figures described above is not new and such a device is presently manufactured and sold by The Steel Heddle Co., Greenville, S.C.; however, such a device has not previously been used as a tension device for a 2-for-1 twister. The present invention provides a substantial improvement in twisting as spun yarn although fully drawn yarn can be processed according to the invention as well. It is, however, significant that prior to the present invention processing as spun yarn on a 2-for-1 twister was difficult because of filament breakage. As is known in the art, as spun yarns have low tenacities and the filaments in such yarns are easily damaged or broken. Since it is desirable to twist such yarns employing a 2-for-1 twister prior to drawing as previously described in the background of the invention, the present invention provides a suitable method and apparatus for twisting such yarns on a 2-for-1 twister. Although drawn yarns generally could be twisted on a 2-for-1 twister satisfactorily prior to the present invention, as spun yarns generally could not. Thus the present invention provides a substantial improvement in the art of twisting yarns, particularly as spun yarns, employing 2-for-1 twisters.

The yarns suitable for use in the invention are synthetic multifilament yarns and although drawn yarns can be twisted employing the apparatus and process of the present invention, the present invention is particularly useful to twist as spun yarns. As used herein the term "as spun yarn" means a continuous filament yarn having a tenacity of less than about 3.0 grams per denier. However, in most instances the as spun yarns used in the present invention will have a tenacity of less than about 2.0 grams per denier and as noted above it is in processing the lower tenacity as spun yarns that the present invention is particularly useful. Based upon the results of the specific example described below it is believed that good results can be obtained twisting an as spun yarn having a tenacity within the range of from about 1.0 to about 1.5 grams per denier. Generally, the yarn employed is a polyamide, polyester or polyolefin yarn; however, the use of other yarns is within the scope of the invention. Good results were obtained using polypropylene as the polyolefin yarn.

In accordance with the invention a 2-for-1 twister manufactured by Verdol, VDL 1515 22-G, Lyon, France was employed in which the Verdol tension device was replaced with a Stehedco model 2004 UTC tension device manufactured by Steel Heddle Co. of Greenville, S.C. The feed yarn was an as spun polypropylene 1750 denier 70 filament yarn having a tenacity of 1.3 grams per denier. The 2-for-1 twister was operated at 4000 rpm and the linear speed of the yarn was 145 meters/minute. This yarn was twisted employing the apparatus and process of the present invention without noticeable filament breakage. Several attempts were made to process this same yarn with the Verdol 2-for-1 twister equipped with the Verdol pinch point type tension device but the yarn broke out repeatedly and produced a yarn with an excessive number of broken filaments.

The term "2-for-1 twister" as used herein is intended to cover modifications known in the art that increase the twist ratio of a 2-for-1 twister from 2 twists per revolution of the spindle to 4 twists per revolution of the spindle, and thus the term "2-for-1 twister" is used in the specification and claims in the generic sense.

I claim:

1. A 2-for-1 twister comprising spindle support means, spindle, disc, tension device and package support means, wherein said spindle is rotatably connected to said spindle support means, said disc is attached to said spindle above said spindle support means, said spindle is rotatably connected to said package support means which is positioned above said disc, and said tension device is attached to said package support means wherein said tension device comprises a fixed member and a movable member, said movable member having a first end and a second end, said first end being hinged to said fixed member in a manner to force the second end of said movable member away from said fixed member, and said fixed member and said movable member having a plurality of yarn guides positioned thereon suitable for producing substantially a sinusoidal yarn path when the yarn is passed from said package to said yarn guides alternating between the guides on the fixed member and the guides on the movable member.

2. The 2-for-1 twister of claim 1 wherein the movable member of the tensioning device is forced away from the fixed member of the tensioning device by the restraining force of a spring having a first end and a second end wherein the first end of said spring is attached to the fixed member and the second end of said spring is attached to the movable member.

3. The 2-for-1 twister of claim 2 wherein the restraining force of the spring is adjustable.

4. A method for twisting an as spun yarn comprising:

passing an as spun yarn from a package of yarn positioned on a 2-for-1 twister to a tensioning zone, then passing the yarn to a 2-for-1 twist spindle from said tensioning zone and twisting the yarn, wherein the yarn in the tensioning zone is passed around a plurality of yarn guides positioned on a fixed member and a plurality of yarn guides positioned on a movable member alternating the yarn between the yarn guides of the fixed member and the yarn guides of the movable member to form a sinusoidal yarn path and wherein the yarn tension decreases as the yarn guides on the movable member move toward the yarn guides on the fixed member.

5. The method of claim 4 wherein the as spun yarn has a tenacity of less than about 3.0 grams per denier.

6. The method of claim 4 wherein the as spun yarn has a tenacity of less than about 2.0 grams per denier.

7. The method of claim 4 wherein the as spun yarn has a tenacity within the range of from about 1.0 to about 1.5 grams per denier.

8. The 2-for-1 twister of claim 1 wherein said fixed member has five yarn guides positoned essentially in a straight line parallel to the longitudinal axis of said tension device and said movable member has four yarn guides positioned essentially in a straight line parallel to the longitudinal axis of said movable member, said yarn guides being positioned so that a yarn threaded through said tension device is wrapped approximately 90° around the first and fifth yarn guides attached to said fixed member and approximately 180° around the second, third and fourth guides attached to said fixed member and the four yarn guides attached to said movable member.

* * * * *